US006439569B1

(12) United States Patent
Lyga

(10) Patent No.: US 6,439,569 B1
(45) Date of Patent: Aug. 27, 2002

(54) SHEET ACCUMULATOR HAVING A CIRCULAR FEED PATH

(75) Inventor: Thomas M. Lyga, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 79 days.

(21) Appl. No.: 09/741,268

(22) Filed: Dec. 19, 2000

(51) Int. Cl.[7] ..... B65H 29/20; B65H 9/00

(52) U.S. Cl. ..... 271/314; 271/226; 414/788.1; 270/58.01

(58) Field of Search ..... 270/58.01; 414/788.1; 271/314, 226, 227, 224, 184, 186

(56) References Cited

U.S. PATENT DOCUMENTS

| | | | | | |
|---|---|---|---|---|---|
| 4,750,853 | A | * | 6/1988 | Van Soest et al. | 198/624 |
| 5,147,092 | A | | 9/1992 | Driscoll et al. | 271/184 |
| 5,356,263 | A | | 10/1994 | Miller | 414/790.7 |
| 5,772,197 | A | * | 6/1998 | Aoki et al. | 270/58.08 |
| 6,176,480 | B1 | * | 1/2001 | Yonenuma et al. | 270/58.08 |
| 6,220,592 | B1 | * | 4/2001 | Watanabe et al. | 270/58.12 |
| 6,290,220 | B1 | * | 9/2001 | Takehara et al. | 270/58.08 |
| 6,381,443 | B1 | * | 4/2002 | Kawata et al. | 270/58.07 |

FOREIGN PATENT DOCUMENTS

| | | | | |
|---|---|---|---|---|
| JP | 357027857 A | * | 2/1982 | 271/184 |
| JP | 359133162 A | * | 7/1984 | 271/187 |
| JP | 020000289916 A | * | 10/2000 | |

* cited by examiner

*Primary Examiner*—Christopher P. Ellis
*Assistant Examiner*—Richard Ridley
(74) *Attorney, Agent, or Firm*—Ronald Reichman; Angelo Chaclas

(57) ABSTRACT

A sheet accumulator of compact design has a circular paper path. Individual sheets moving along a main (linear) path enter the accumulator one by one, and each sheet is then diverted onto and around the perimeter of a set of driven disks. The disks are parallel to each other and perpendicular to the paper sheets. The disks then urge each sheet against a set of stops. Each subsequent sheet enters the circular path between the disks and the previous sheet, so that it too is urged and registered against the stops. When the accumulation is complete, the stops are retracted and a set of rolls is engaged to exit the sheets out of the accumulator. The accumulated stack of sheets is then diverted back into the main (linear) paper path.

11 Claims, 3 Drawing Sheets

SHEET ACCUMULATOR HAVING A CIRCULAR FEED PATH

CROSS REFERENCE TO RELATED APPLICATIONS

Reference is made to Application Ser. No. 09/741576 entitled RECIRCULATING GRIPPER ACCUMULATOR HAVING A CIRCULAR PAPER PATH, assigned to the assignee of this application and filed on even date herewith.

TECHNICAL FIELD

The present invention relates to paper sheet accumulators, and more particularly to a paper sheet accumulator wherein paper sheets are accumulated individually and then dispensed collectively as a stack.

BACKGROUND OF THE INVENTION

Various accumulators have been used for accumulating paper sheets and documents into stacks and then transporting the accumulated stacks. For example, Driscoll, et. al (U.S. Pat. No. 5,147,092) disclose a flat accumulator comprised of upper and lower sets of driven elastic belts.

While a flat type of accumulator is appropriate for some applications, its dimensions are too large or bulky for other applications. This related art cannot conform to space limitations and layout of certain machines in which a sheet accumulator must form a component part.

In addition to problems of size and shape, the related art also has problems due to the need for paper buckling. For example, Miller, (U.S. Pat. No. 5,356,263) discloses a sheet accumulator in which it is necessary for sheets of paper to buckle very substantially. This becomes problematic, however, when the sheet of paper has characteristics that are not consistent with normal buckling, perforated paper being one example.

SUMMARY OF THE INVENTION

The primary objective of this invention is to provide a sheet accumulator for accumulating sheets of paper seriatim (i.e. one by one), and for then allowing the stack of accumulated sheets to exit the device. Another objective of the present invention is to minimize the amount of space required by the accumulating apparatus. Accordingly, the present invention is a compactly designed sheet accumulator in which the paper path is circular. This design conforms to space limitations which other sheet accumulators, such as flat accumulators, are unable to do.

In one embodiment of the present invention, individual sheets of paper moving along a main (linear) path enter into the accumulator one at a time, whereupon each sheet is diverted onto and around a set of rotating, driven disks. The disks are parallel to each other and perpendicular to the paper sheets. Before each sheet of paper completes a full circle, the disks urge each sheet against a set of stops, and each subsequent sheet enters the circular path between the disks and the previous sheet, so that it too is urged and registered against the stops. When the accumulation is complete, the stops are retracted and a set of rollers is engaged to exit the stack of sheets out. The accumulation of sheets then reenters the main (linear) paper path.

The present invention is designed to offer a sheet accumulator with a new compact configuration that allows the accumulator to fit into spaces where other sheet accumulators cannot fit. The present invention is also designed in such a way as to easily handle paper prone to buckling, such as perforated paper.

DETAILED DESCRIPTION

Figure 1:
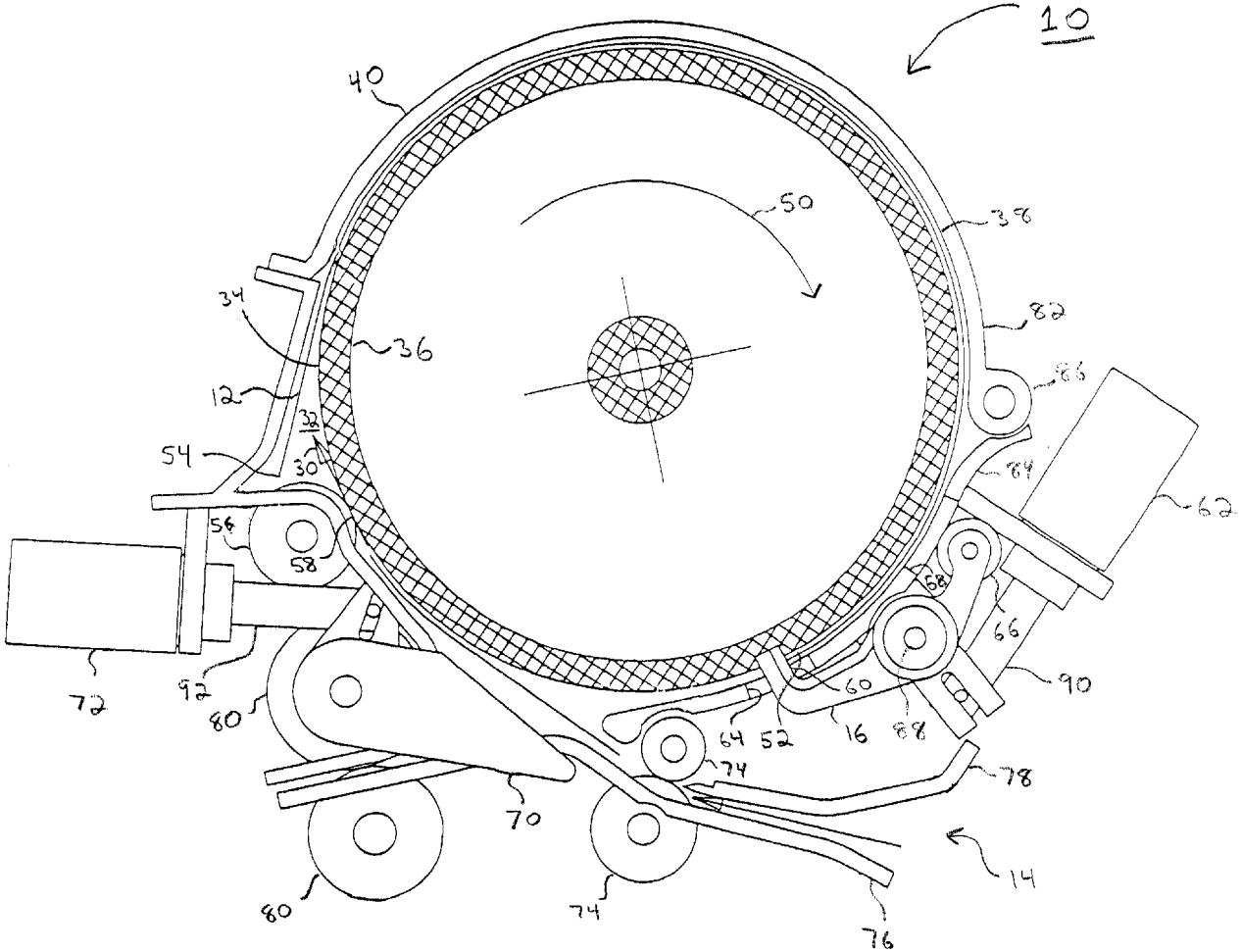
FIG. 1 is a side view of the sheet accumulator taken along line 1-1 of FIG. 3, showing the accumulator as it receives sheets of paper.
Figure 2:
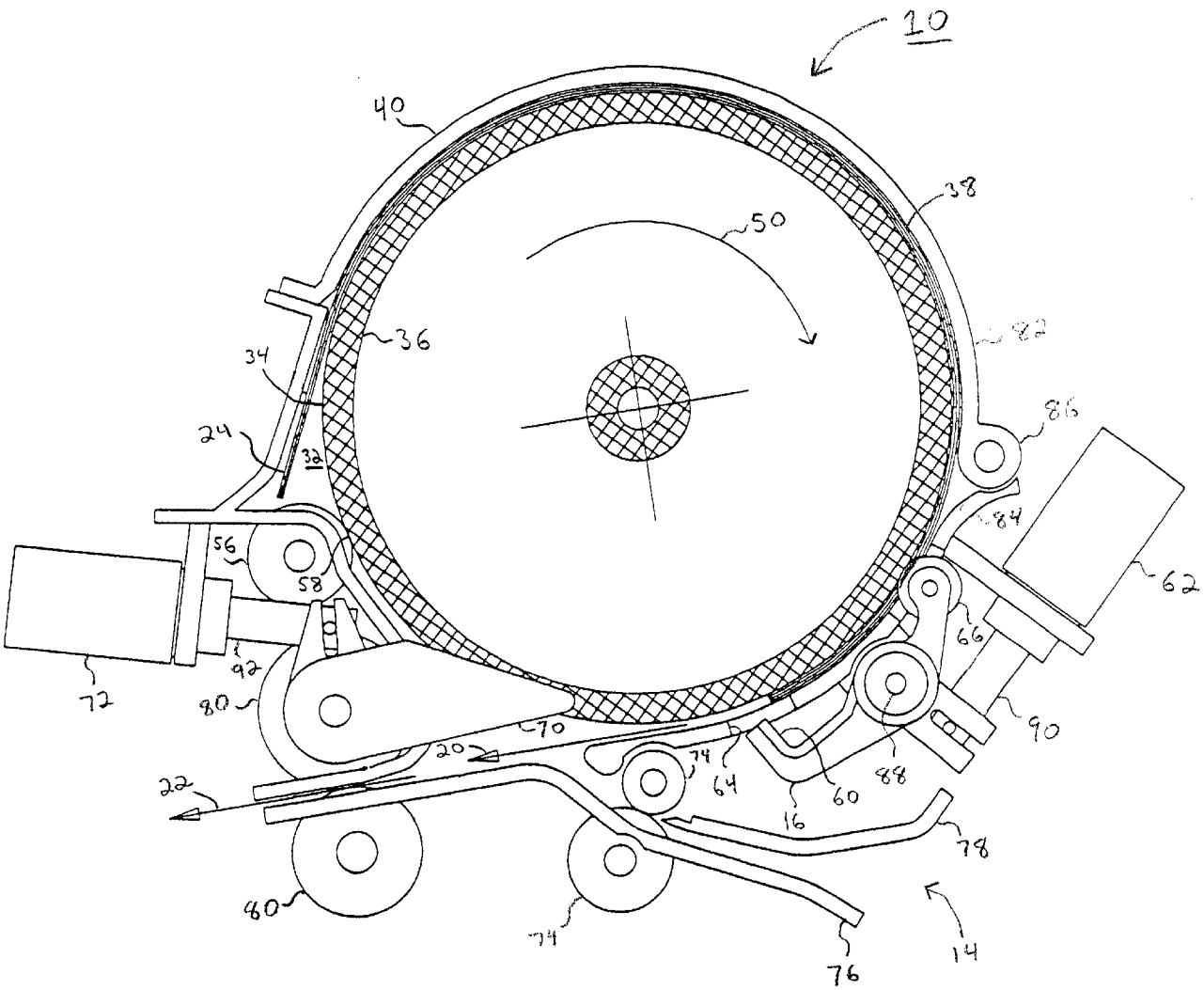
FIG. 2 is another side view of the sheet accumulator similar to that as taken in FIG. 1, showing the accumulator as it dispenses a stack of paper.
Figure 3:
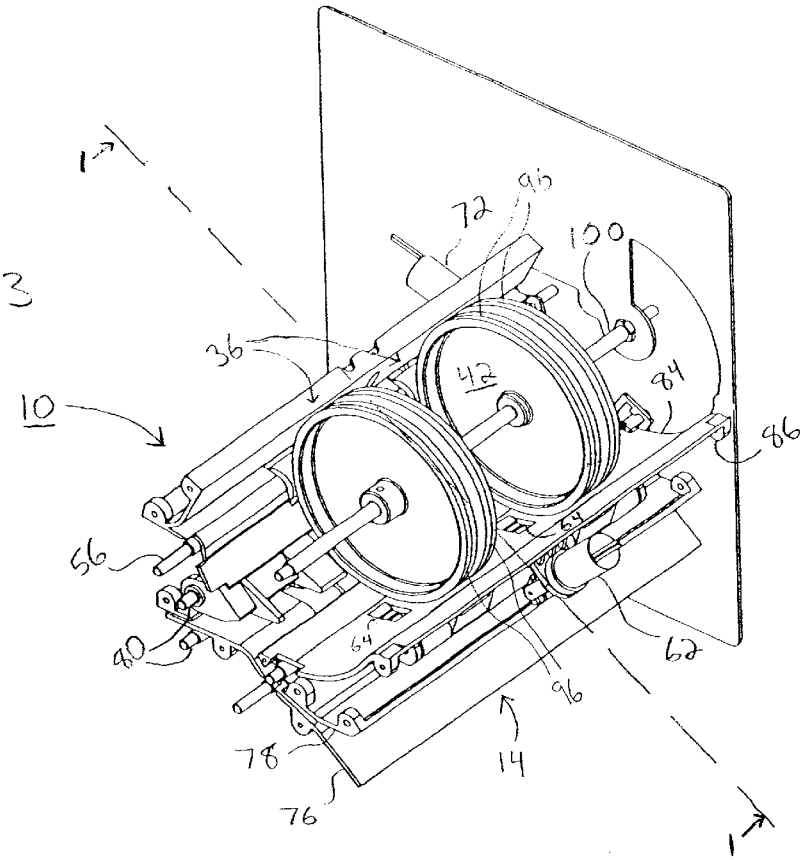
FIG. 3 is a perspective view of the accumulator.

As best seen in FIGS. 1, 2, and 3, sheet accumulator 10 has a circular paper path defined by a circular channel 32. Each sheet of paper 12 is fed into the accumulator one by one at entry point 14, sheets accumulate in the accumulator at stops 16, and then sheets exit the accumulator as shown by arrows 20 and 22 in the form of a stack of sheets 24. Each sheet of paper 12 moves in a circular direction 30, through a circular channel 32 located between the outer perimeter 34 of a rotating circular device 36 and the inner periphery 38 of a substantially circular accumulator guide 40 which surrounds the circular device 36. FIG. 1 is a side view of the accumulator 10 as it accumulates each sheet of paper 12 which moves through the circular channel 32. FIG. 2 is a side view of the accumulator 10 as sheets exit the accumulator at arrows 20 and 22. FIG. 3 is a perspective view, showing an embodiment of this invention in which the circular device 36 comprises a set of disks 42 connected to each other by a linkage 100 which may simply be an axle.

The rotation direction 50 of the disks 42 does not change. Thus, although the disks 42 may stop and start, they do not reverse their direction of rotation 50.

As seen in FIG. 1, each sheet of paper 12 moves until its leading edge 52 reaches stops 16, at which time the paper's trailing edge 54 is pre-dispositioned to unbend and thus move away from the circular device 36 and away from idler input rollers 56. The idler input rollers 56 form a nip 58 with the disks 42, and thus propel each sheet of paper along its circular path almost to the stops 16. Residual inertia of the paper, combined with the urging force of the sheet pressing against the disks 42, enables the leading edge 52 of each sheet to reach and register against the stops 16. As the sheet registers against the stops 16, it is free to align itself against the face 60 of the stops 16, and the sheet then stops while the disks 42 slip along a side of the sheet.

As seen in FIG. 1, a second sheet of paper enters the circular path in the direction 30, between the trailing edge 54 of the first sheet and the disks 42. This process repeats, until, as shown in FIG. 2, a stack of sheets 24 accumulates in the accumulator. Once the stack 24 is accumulated to a desired amount, the disks 42 stop rotating. A first actuator 62 causes the stops 16 to retract through first apertures 64 in the guide 40, to a withdrawn position allowing the stack to exit. Then the first actuator 62 causes exit rollers 66 to move through second apertures 68 and press against the stack 24. The disks 42 then begin to rotate causing the exit rollers 66 to turn, and thus the stack of sheets 24 exits the accumulator 10 in direction 20.

FIG. 1 shows the stops 16 prior to retraction. FIG. 1 also shows the exit rollers 66 prior to engagement.

FIG. 2 shows the stops 16 after retraction to the withdrawn position. FIG. 2 also shows the exit rollers 66 in the engaged position.

A movable deflector 70 can be used to facilitate entry of sheets into the accumulator by deflecting them into the circular channel 32. This movable deflector 70 is shown in its input position in FIG. 1, and in its output position in FIG. 2. A second actuator 72 moves the movable deflector 70 from its input position to its output position when the stops 16 are retracted. In its output position, the movable deflector 70 will allow a stack 24 to exit the circular channel 32 without being deflected back into the circular channel.

The sheet accumulator may also comprise driven input rollers 74 for inputting sheets one by one toward the deflector 70. Furthermore, the sheet accumulator may comprise a lower lip 76 and an upper lip 78 for guiding each input sheet of paper to the input rollers 74. Further, the sheet accumulator may have driven takeaway rollers 80 to help exit each stack 24 from the accumulator after the stack is urged forward by the exit rollers 66.

It should be noted that the circular device 36 may use a cylinder instead of disks 42. In either case, rubber O-rings 96 may be installed around the outer perimeter 34. The circular device 36 may also be positioned below the entry point 14, instead of above it as depicted in the drawings. The substantially circular accumulator guide 40 may be divided into parts, including a removable guide 82 connected to an immovable guide 84 by a hinge 86. Each stop 16 may be connected to each exit roller 66 by a pivot member 88. The first actuator 62 and the second actuator 72 may respectively include a first piston 90 and a second piston 92 for directly actuating movement.

It is possible for the circular device 36 to be in constant rotation instead of stopping each time the stops 16 are retracted. The purpose of stopping the circular device 36 when the stops 16 are retracted is so that the innermost of the sheets forming the stack of sheets 24 will not exit the accumulator before the outermost sheets. That could cause shingling or skewing of the sheets relative to each other, but shingling and skewing will not occur to any significant extent if the stop 16 is retracted with sufficient quickness as compared to the rotational speed of the circular device 36.

Figure 4:
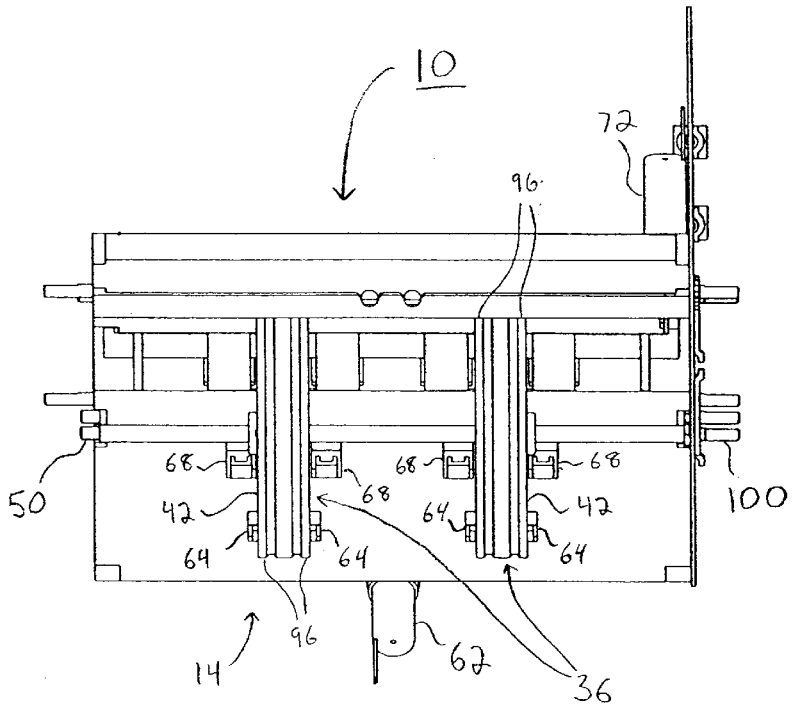
FIG. 4 is a top plan view of the accumulator.

The perspective view of FIG. 3 omits the removable guide 82 for clarity. Likewise, FIG. 4 shows a plan view of the accumulator, again omitting the removable guide 82 for the sake of clarity. Both FIGS. 3 and 4 show a linkage 100 which ensures synchronous rotation of the disks 42.

It is noteworthy that the normal force of the sheet 12 pressing against the disks 42 is a function of the sheet's own natural stiffness as it is bent around the circular channel 32. The stiffer the sheet 12, the greater the normal force. In this manner, thin light weight paper, which is more prone to buckling in a lead edge registered accumulator, has its driving force limited by its own flexibility. On the other hand, stiffer paper, which will both require more driving force and can tolerate a higher buckling load, will have a higher normal force due to its own greater natural stiffness. In this manner, the disks 42 are able to slip against the sheet 12 after registration against the stops 16, without excessive buckling forces being generated, thereby minimizing potential sheet damage.

Certain changes may be made in the above construction without departing from the scope of the invention, as will be understood by those skilled in the art, and it is intended that all matter contained in the above description or shown in the accompanying drawings shall be interpreted as illustrative and not in a limiting sense.

What is claimed is:

1. A sheet accumulator comprising:

(a) a rotatable circular device having an outer perimeter;

(b) a circular guide having an inner periphery, proximate to the outer perimeter of the circular device, for forming a substantially circular channel;

(c) a set of one or more rollers, adjacent to the outer perimeter of the circular device, for forming a nip with the circular device that urges sheets of paper to enter the channel one by one, and for causing the entered sheets to move in a circular motion when the circular device is caused to rotate; and (d) a set of one or more stops, adjacent to the circular channel and remote from the nip, movable from a first position, blocking the circular channel so as to stop the circular motion of the entered sheets thus forming a stack, to a second position removed from the circular channel so as to allow the stack of sheets to exit the accumulator.

2. The sheet accumulator of claim 1, further comprising means for removing the stack from the channel.

3. The sheet accumulator of claim 2, further comprising means for temporarily halting the rotation of the circular device, in order to inhibit sheets from moving while the stops are moved from the first position to the second position.

4. The sheet accumulator of claim 2, wherein the stack removing means comprises exit rollers adjacent to the stop, for urging the stack to be removed from the channel.

5. The sheet accumulator of claim 2, wherein the stack removing means comprises takeaway rollers for urging the stack to be removed from the sheet accumulator after it has left the circular channel.

6. The sheet accumulator of claim 1, wherein the circular device comprises at least two disks having a linkage ensuring synchronous rotation of the disks, each disk having a substantially similar circumference for defining the outer perimeter of the circular device.

7. The sheet accumulator of claim 2, wherein the sheet accumulator further comprises:

(a) a movable deflector, located adjacent to one end of the circular channel at a point before the paper reaches the nip, having an input position for deflecting paper into the channel, and having an output position for allowing stacks of paper to exit the channel without being deflected back into the channel;

(b) a plurality of input rollers, located adjacent to the movable deflector, for inputting sheets one by one onto the movable deflector, thence to the nip, and thence into the channel; and (c) a plurality of lips, located adjacent to the input rollers, for guiding each input sheet of paper to the input rollers.

8. The sheet accumulator of claim 1, wherein the stops are moved between the first position and second position by a first actuator.

9. The sheet accumulator of claim 7, wherein the movable deflector is moved between its input position and output position by a second actuator.

10. The sheet accumulator of claim 1, wherein the sheets have a uniform length, and the stops are separated from the nip by a distance which is greater than the length of the sheets.

11. The sheet accumulator of claim 1, wherein the sheets have a length selected by the user from at least two length options, and the stops are separated from the nip by an adjustable distance which is greater than the user-selected length of the sheets.

* * * * *